United States Patent [19]

Park et al.

[11] 4,352,721

[45] Oct. 5, 1982

[54] PROCESS FOR APPLYING DESIGNS TO ALUMINUM STRIP

[75] Inventors: Timothy A. Park, Derby; Brian C. Turner, Bletchley, both of England

[73] Assignee: Ano-Coil Limited, Bletchley, England

[21] Appl. No.: 208,168

[22] Filed: Nov. 14, 1980

Related U.S. Application Data

[63] Continuation of Ser. No. 14,567, Feb. 23, 1979, abandoned, which is a continuation of Ser. No. 811,125, Jun. 28, 1977, abandoned.

[30] Foreign Application Priority Data

Jun. 28, 1976 [GB] United Kingdom ..... 26840/76

[51] Int. Cl.[3] ..... C23F 5/00; B41M 1/08; B41M 1/28

[52] U.S. Cl. ..... 204/35 N; 8/471; 101/470; 156/240; 204/38 A

[58] Field of Search ..... 8/470–471; 101/470; 204/18, 35, 35 N, 38 A; 156/240

[56] References Cited

U.S. PATENT DOCUMENTS

| | | | |
|---|---|---|---|
| 2,501,495 | 3/1950 | Carroll | 101/470 |
| 2,503,759 | 4/1950 | Murray | 427/56 |
| 2,594,290 | 4/1952 | Chayannes | 101/171 |
| 2,683,113 | 7/1954 | Prance | 204/38 A |
| 2,812,295 | 11/1957 | Patrick | 204/38 A |
| 2,824,828 | 2/1958 | Homer | 204/38 A |
| 2,990,304 | 6/1961 | Cybriwsky | 204/38 A |
| 3,016,293 | 1/1962 | Cybriwsky | 8/485 |
| 3,258,381 | 6/1966 | Howe | 156/240 |
| 3,484,342 | 12/1969 | Blake | 204/18 |
| 3,563,865 | 2/1971 | Blake | 204/35 |
| 3,788,106 | 1/1974 | True | 101/470 |

OTHER PUBLICATIONS

Transfer Prints: The Current State of the Art; by C. E. Villins; Coulourage, annual 1974; pp. 30–41.

Vacuum Printing on Carpet Tiles; Textile Manufacture; vol. No. 100; pp. 30 & 32; Jan. 1973.

Dixon; Electroplating and Metal Finishing; Mar. 1974; The Transfer Printing of Anodized Aluminum; pp. 9–13.

*Primary Examiner*—Clyde I. Coughenour

*Attorney, Agent, or Firm*—Staas & Halsey

[57] ABSTRACT

A process is provided for continuously printing anodized aluminum strip by transfer from a carrier web of a design in printing ink containing colored sublimable components, the process comprising feeding an unsealed anodized aluminum strip to a heated moving surface, such as an internally heated drum, and simultaneously feeding the carrier web into contact with the aluminum strip so that the printing ink is heated by contact with the anodized aluminium surface and colored components of the ink are caused to transfer by sublimation from the carrier web to the aluminum strip.

14 Claims, 1 Drawing Figure

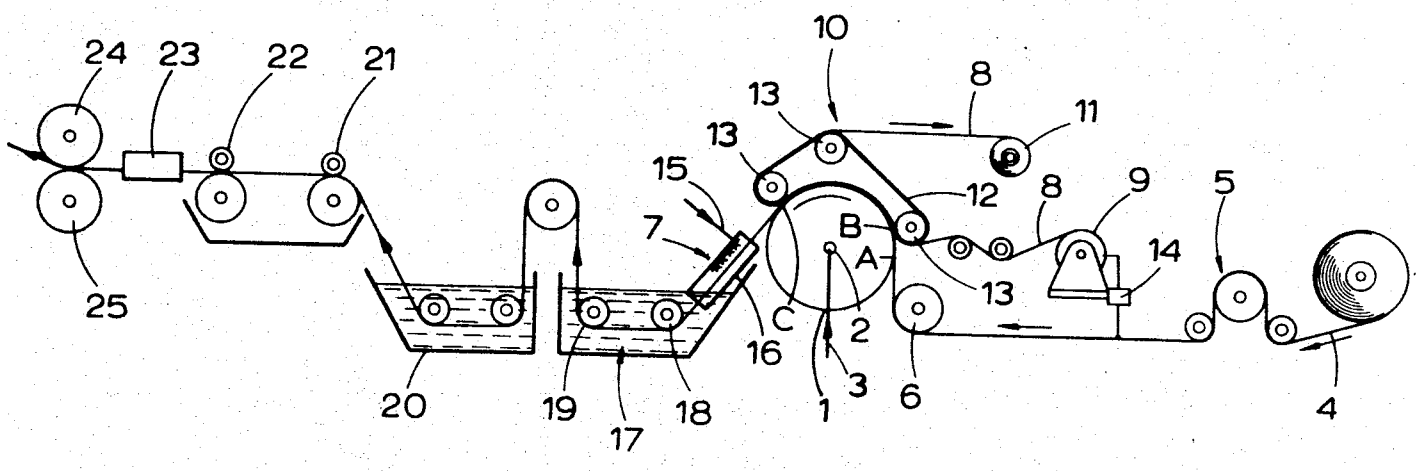
1
2
3
4
5
6
7
8
8
9
10
11
12
13
13
13
14
15
16
17
18
19
20
21
22
23
24
25
A
B
C

PROCESS FOR APPLYING DESIGNS TO ALUMINUM STRIP

This is a continuation, of Application Ser. No. 014,567 filed Feb. 23, 1979 which in turn is a continuation of application Ser. No. 811,125 filed June 28, 1977 both abandoned.

BACKGROUND OF THE INVENTION

1. Field of the Invention

This invention relates to the application of designs to anodised aluminum strip by a printing technique.

2. Description of the Prior Art

Anodised aluminum strip is widely used as decorative trim in consumer durables such as motor vehicles, radio and television sets, for architectural and interior decoration and similar purposes and such uses take advantage of the receptivity of the anodic oxide surface for conventional printing inks.

Aluminum strip can be decorated continuously (i.e. in coil form) by dipping the strip into dye baths, using resists and successive dye baths to obtain multi-colour effects, or by direct printing onto the aluminum surface. However such processes are not easy to control and high quality multi-colour decoration is difficult to achieve. A process has also been proposed for decorating aluminum sheet in U.K. Pat No. 1,052,625 in which a design is transferred from a temporary carrier sheet but such technique is only applicable to the printing of individual sheets of aluminum and the process has not been adopted commercially.

A process which enabled a design to be applied continuously to an anodised aluminum strip would be highly desirable since it would greatly increase the potential printing speed and, because of the larger areas of decorative aluminum sheet of various designs which could be produced, would greatly extend the range of uses to which the material could be put.

SUMMARY OF THE INVENTION

According to the present invention there is provided a process for continuously printing anodised aluminum strip by transfer from a carrier web of a design in printing ink containing coloured sublimable components, said process comprising feeding an unsealed anodised aluminum strip to a heated moving surface, and feeding said carrier web into contact with the aluminum strip so that the printing ink is heated by contact with the anodised aluminum surface and coloured components of the ink transfer by sublimation from the carrier web to the aluminum strip. Sealing of the printed strip may be carried out immediately after the printing of the unsealed aluminum surface or the printed strip may be coiled after cooling and sealed subsequently.

DETAILED DESCRIPTION OF THE INVENTION

The term "design" as used in this specification includes letters, numerals, indicia and informative symbols as well as decorative patterns and the designs may be coloured or black and white, monochromatic or multicoloured. Where the design includes more than one sublimable coloured components, the temperatures of sublimation should preferably be as close as possible in order to ensure that their transfer to the anodic film occurs at substantially the same rate.

The anodised strip may be pre-coloured, e.g. by application of a mordant or disperse dye to the unsealed strip to give a background colouration and the resulting strip then printed with a superimposed design by the transfer process described above.

Preferably the aluminium strip is fed into contact with the heated surface in advance of its contact with the carrier web so that the aluminium is heated by conduction to a temperature at or close to the sublimation temperature of the coloured components prior to contact with the carrier web. This results in radid sublimation and uniform transfer of the coloured components to the anodic film.

The heated moving surface is conveniently a drum, having a metal surface, which is heated internally by circulation of a heated fluid, such as an oil, through its interior. By means of a thermostatically controlled heater for the oil, the temperature of the exterior surface of the drum can be selected to suit the particular printing ink being used. Other arrangements are, however, possible such as an endless metal belt heated by passage through an oil bath or by infra-red heaters disposed beneath the belt.

In order to ensure good mutual contact without slipping and reliable transfer between the carrier web and the aluminium strip, the carrier web is urged into contact with the aluminium strip and travels with the aluminium strip around the drum for a period of up to about 30 seconds, preferably 7 to 16 seconds, typically about 10 to 15 seconds. This can be achieved by pressing the carrier into contact with the aluminium using a web of asbestos fabric or other heat-resistant material.

Experience with the continuous process has shown that the design transferred onto the aluminium strip can deteriorate and become blurred, probably through resublimation of the coloured component(s) from the hot strip and migration through the anodic film, if the aluminium strip is not cooled as soon as possible after transfer of the design. Preferably therefore the aluminium strip is cooled, e.g. with a water spray or air or gas blast, immediately after the carrier web is parted therefrom, to a temperature substantially below the sublimation temperature of the dyes, for example below 90° C. preferably below 30° C.

Any of the sublimable dyestuffs conventionally used in printing inks for aluminium surfaces may be used in preparing the ink applied to the carrier webs. Such dyestuffs are usually disperse dyes, e.g. azo dyes or anthraquinone dyes. Specific commercial dyestuffs include the water-soluble aluminum dyestuffs marketed by Sandoz Products Ltd., and the azo and anthraquinone dyes referred to in the Colour Index as C.I. disperse yellow 3 and C.I. disperse blue 14. These dyes have the structural formulae:

C.I. disperse yellow 3

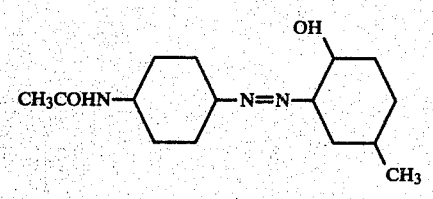

C.I. disperse blue 14

-continued

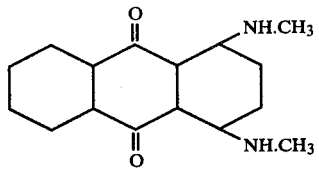

Suitable sublimable dye or dyes normally sublime at temperatures within the range of about 160° to 240° C. and are advantageously selected so that they sublime at similar temperatures. Printing inks containing the sublimable dyes can be formulated using a binder and other conventional ink ingredients which are stable and do not melt at the temperatures at which the transfer takes place. Examples of suitable ink formulations are described in British patent specification No. 1,391,012 and French patent specification No. 1,223,330. The carrier web on which the design is printed may be any sheet material having reasonable strength and resistance to the sublimation temperatures, e.g. paper or polyester film.

According to a preferred embodiment of the invention there is provided a process for continuously printing anodised aluminium strip by transfer from a carrier web of a design in printing ink containing coloured sublimable components, said process comprising feeding an unsealed anodised aluminium strip to a heated rotating drum, simultaneously feeding said carrier web into contact with the aluminium strip and maintaining the carrier web and said aluminium strip in intimate, mutually stationary contact with each other and with the surface of the drum so that the printing ink is heated to a temperature at which the coloured component of the ink sublime and then rapidly cooling the anodised strip bearing the transferred design.

The invention includes printed aluminium strip whenever produced by the process described above.

The process of the present invention is illustrated by the following description of a preferred embodiment in conjunction with the accompanying schematic drawing of apparatus suitable for carrying out the process.

Referring to the drawing, the apparatus comprises a hollow drum 1 which is mounted for rotation about a tubular axle 2 and heated by passing heated oil through a supply pipe 3 into the drum via the tubular axle 2. The oil is circulated through a cavity formed by the outer surface of the drum and a double inner skin is returned via the other end of the axle 2 to a thermostatically controlled heater (not shown) before reintroduction into the drum. Anodised aluminium strip 4 is fed from a supply coil (or directly from an anodising plant) to the drum 1 via a tensioning unit 5 and guide roller 6. As can be seen from the drawing, the anodised strip initially contacts the drum at a point A and travels in mutual contact with the drum to a point C where it is transported away through a cooling unit generally indicated at 7.

Again, referring to the drawing, a carrier web 8, which bears the printed design to be transferred to the aluminium strip is supplied from a roll 9, passes around a transfer unit, generally indicated at 10, and is reeled at 11 after transference of the design. The transfer unit 10 comprises a frame pivotally mounted on an axis so that the unit can be pivoted into and out of engagement with the drum for changing the carrier web. Carrier web 8 is fed from supply roll 9 to an asbestos pressure blanket 12 by means of which the transfer strip is urged into contact with the aluminium strip on the drum 1. As shown in the drawing, the pressure blanket is in the form of an endless belt and is driven on rollers 13 at the same linear speed as the aluminium strip on the drum so that there is no tendency for mutual slipping between the carrier web and the aluminium strip. It has been found that there is no need to apply high pressure between the blanket and the drum and that the mere weight of the transfer unit 10 acting about the axis on which it is pivoted is enough to ensure good transfer in the process of the invention. Carrier web 8 initially contacts the anodised surface of the aluminium strip at a point B downstream with respect to the direction of rotation of the drum 1 of the point A where the aluminium strip initially contacts the drum. The supply roll 9 for the carrier web is tracked pneumatically by sensor 14 to ensure close alignment of the edges of the carrier web and aluminium strip. The speed of rotation of the drum 1 is such that the time taken for an element of the aluminium strip to travel between point A and B is about 2 to 7 seconds (usually 4 to 5 seconds) so that by the time the carrier web is brought into contact at B with the anodised aluminium surface, the aluminium has been heated to a temperature at or close to the sublimation temperature of dyestuffs in the printing ink on the carrier web. The exhausted carrier web is transported away from the drum at C to take-up spool 11. The distance between point B and C is not critical but satisfactory results have been obtained with a residence time of the aluminium strip in contact with the transfer strip of between about 7 and 16 seconds, typically between 10 and 15 seconds.

The hot aluminium strip bearing the transferred design is cooled as quickly as possible and this is conveniently achieved in the cooling unit 7 by applying a water spray 15 at the upper end of a tubular housing 16 through which the printed aluminium is led into a water bath 17. After passage through the water bath 17 and around guide rolls 18 and 19, the cooled strip is guided into a sealing bath 20 which is filled with a suitable sealing solution such as buffered aqueous nickel acetate at 90° to 100° C.

After sealing, the strip is drawn through a pair of rubber rollers 21 and 22 which squeeze off the majority of the water, the residual water being dried off by a heater 23. The aluminium strip 4 is drawn through the apparatus by main drive rollers 24 and 25 and no additional drive means is necessary since the drive for the carrier web take-up spool 11 and the asbestos blanket rollers 13 can be taken by belt or similar connection from the drum 1.

Although the apparatus described above includes a sealing bath, the printed aluminium strip can be stored after drying for a limited period (up to a few weeks) prior to sealing.

The temperature at which the drum surface is maintained depends upon the sublimation temperature of the dyestuffs in the printing ink but good results have been achiebed with standard dyestuffs at temperatures between about 180° and 250° C., preferred temperatures being in the range 200°–210° C.

The preferred material for the carrier sheet is heavy calendered paper since this is reltively cheap and can withstand the temperature at which the dyestuffs sublime. The vehicle of the ink may be selected from conventional ink resins which are unaffected by the temperature of the drum and may be thinned with water or organic solvents for printing onto the carrier web. A relatively thick layer of ink is desirable and the ink is conveniently printed onto the carrier strip by a gravure process.

Typical speeds of operation of the apparatus described above are 450 to 1,000 feet per hour, e.g. 600 feet per hour. The time lapse between parting the carrier web from the aluminium strip and application of the forced cooling in the cooling unit 7 is as short as possible and the aim is to apply the cooling fluid within 1.5 to 2 seconds of the aluminium strip leaving the drum.

Anodising conditions in the production of the starting material for the process can vary but better quality transfer is obtained by using relatively high concentrations of sulphuric acid (e.g. 20 to 25%) and a temperature in the range of about 35° to 45° C., preferably 40° C., in the anodising bath. It is believed that the improved transfer under these conditions arises from the production of more open structure in the anodic film which results in more rapid uptake of the dyestuffs.

Generally, the rate of uptake of the dyestuffs is approximately proportional to the thickness of the anodic film up to anodic film thicknesses of 1 to 5 microns. Thereafter the thickness of the film appears to have little effect upon the dye transfer and accordingly we prefer to employ aluminium having an anodic film of 3 to 5 microns in thickness.

Various surfaces of the aluminium strip starting material can be employed to vary the final effect, e.g. by brushing to achieve a "satin" effect.

The term strip has been used throughout this specification to describe the aluminium starting material but this is not intended to place any limitation upon the thickness of the starting material. Sealing of the printed aluminium strip may be carried out in conventional manner, e.g. by immersion in a bath of water at a temperature close to boiling point e.g. 95° to 100° C. Preferably a sealing additive such as nickel acetate is included in the bath.

What is claimed is:

1. A process for continuously printing anodised aluminum strip by transfer from a carrier web of a design in printing ink containing colored sublimable components, said process comprising:

(a) continuously feeding an unsealed, anodised aluminum strip to a moving surface heated to a temperature at which said colored components of the ink sublime and heating the strip by contact with the surface of said moving surface in advance of its contact with the carrier web so that the aluminum is pre-heated before contact with the carrier web;

(b) feeding said carrier web into contact with the aluminum strip so that the printing ink is heated by contact with the anodised aluminum surface and colored components of the ink are caused to transfer from the carrier web to the aluminum strip;

(c) rapidly quenching the strip after transfer of the design thereto by contacting the strip substantially instantaneously with a coolant after leaving the heated moving surface and prior to sealing the anodised aluminum surface; and (d) thereafter sealing the anodised aluminum surface.

2. A process according to claim 1 in which the strip is cooled by application of water.

3. A process according to claim 1 in which the heated moving surface is a drum.

4. A process according to claim 3 in which the drum is heated internally by passing a heated fluid therethrough.

5. A process according to claim 1 in which the carrier web and aluminum strip are maintained in contact, at a temperature at which coloured components of the ink sublime, for a dwell period of 7 to 16 seconds.

6. A process according to claim 1 in which the anodised aluminum strip has an anodic film thickness of 3 to 5 microns.

7. A process according to claim 1 in which the unsealed anodised aluminum strip is pre-dyed to give a background colouration prior to transfer of the design.

8. A process according to claim 1 in which the heated surface is heated to a temperature in the range of 150° to 240° C.

9. A process according to claim 1 in which the strip is quenched by application of a cooling liquid within about 2 seconds of parting of the carrier web from the strip.

10. A process according to claim 1 in which step (d) includes passing the strip obtained in step (c) continuously to a sealing bath.

11. A process according to claim 10 in which the sealing bath is maintained at a temperature of 90°–100° C.

12. A product by the process of claim 1.

13. A process for continuously printing anodised aluminum strip by transfer from a carrier web of a design in printing ink containing colored sublimable components, said process comprising:

(a) continuously feeding an unsealed, anodised aluminum strip to an internally heated rotating metal drum having a surface maintained at a temperature at which said colored components of the ink sublime in advance of its contact with the carrier web so that the aluminum is pre-heated before contact with the carrier web, (b) feeding said carrier web into contact with the aluminum strip at a point downstream from the initial contact point between the strip and the drum and maintaining the strip and the carrier web in mutually stationary contact with each other for a period of about 7 to 16 seconds while the drum rotates through a sector to effect said transfer, and (c) quenching the strip by application of a cooling liquid within about 2 seconds of parting of the carrier web from the strip.

14. A product by the process of claim 13.

* * * * *